US005522376A

United States Patent [19]

Collinsworth

[11] Patent Number: 5,522,376

[45] Date of Patent: Jun. 4, 1996

[54] BOW HANDLE

[76] Inventor: James C. Collinsworth, P.O. Box 6848-286, Big Bear Lake, Calif. 92315

[21] Appl. No.: 236,180

[22] Filed: May 2, 1994

[51] Int. Cl.[6] ..... F41B 5/00

[52] U.S. Cl. ..... 124/86; 124/23.1; D22/107

[58] Field of Search ..... 124/23.1, 24.1, 124/25.6, 86, 88, 89; D3/254, 262, 318, 328, 904; D22/107

[56] References Cited

U.S. PATENT DOCUMENTS

| | | | |
|---|---|---|---|
| 3,834,368 | 9/1974 | Geiger | 124/88 X |
| 4,343,286 | 8/1982 | Thacker | 124/88 X |
| 4,457,287 | 7/1984 | Babington | 124/88 X |
| 4,674,471 | 6/1987 | Lance | 124/86 |
| 5,161,514 | 11/1992 | Cary | 124/24.1 |

*Primary Examiner*—Eric K. Nicholson
*Assistant Examiner*—John A. Ricci

[57] ABSTRACT

A bow handle for holding and carrying a bow comprising a rigid arm having a base end, a tip end, and an intermediate location therebetween with a base segment extended outwards from the intermediate location to the base end and a tip segment extended outwards and away from the base segment from the intermediate location to the tip end; a first coupling mechanism for coupling the base end of the arm to the bow handle; a collar coupled to the tip end of the arm; a stabilizer rod having a tip end adapted to be positioned in contact with the handle of a bow and a free end slidably disposed through the collar; a string guide mechanism coupled to the stabilizer rod and adapted for receiving and holding a plurality of bow strings extended across a bow handle; and a second coupling mechanism for fixing the position of the stabilizer rod relative to the collar.

3 Claims, 3 Drawing Sheets

FIG. 1
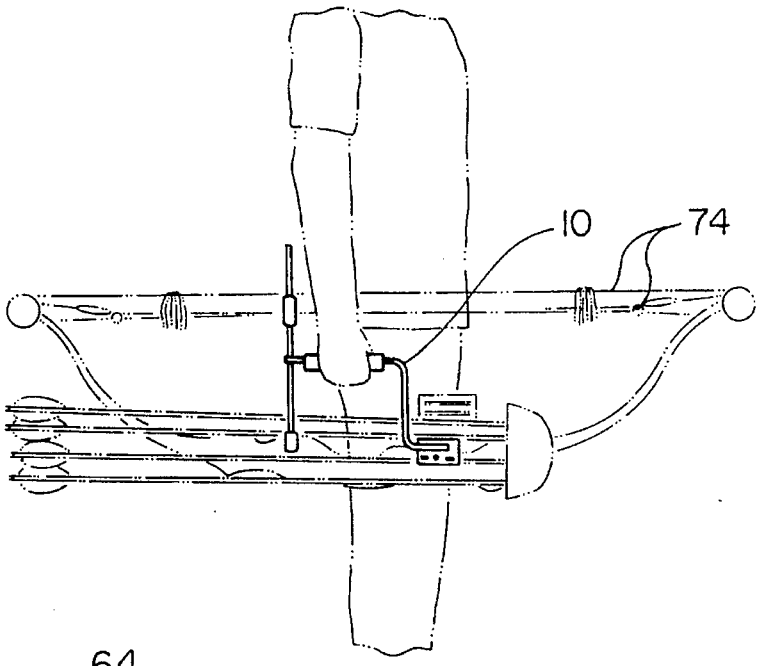
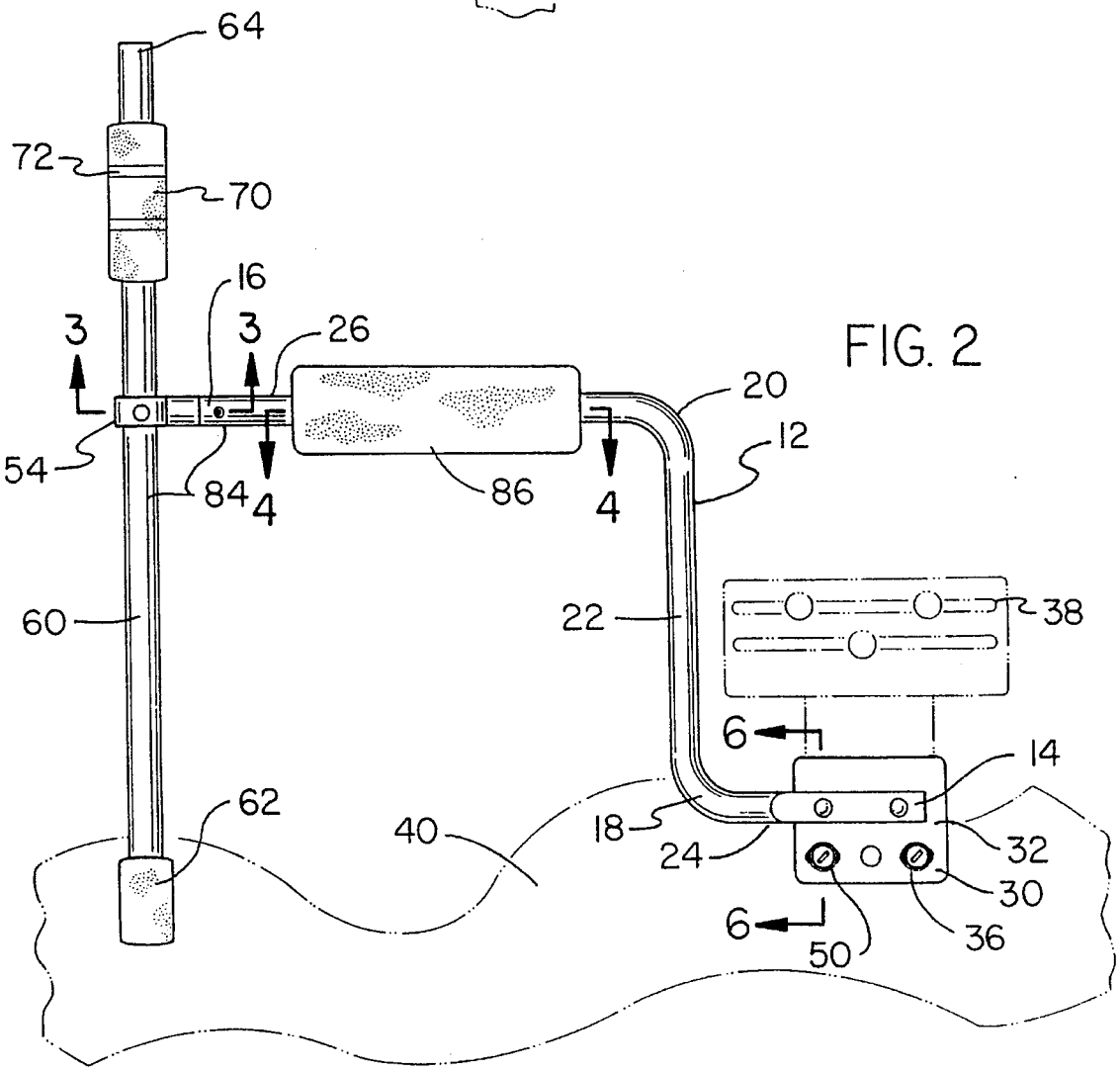
FIG. 2

FIG. 5
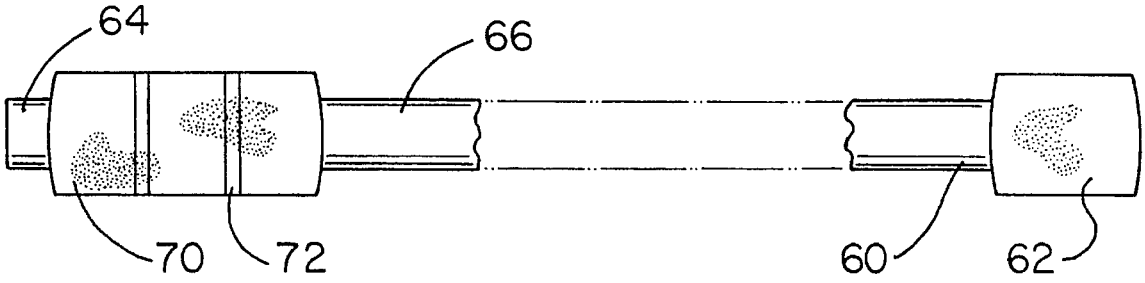
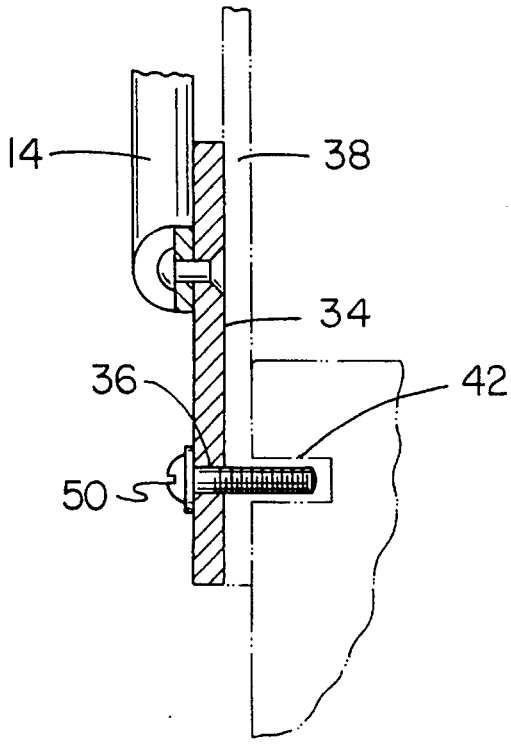
FIG. 6

BOW HANDLE

BACKGROUND OF THE INVENTION

1. Field of the Invention

The present invention relates to a bow handle and more particularly pertains to holding and carrying a bow with a bow handle.

2. Description of the Prior Art

The use of bow handles is known in the prior art. More specifically, bow handles heretofore devised and utilized for the purpose of holding and carrying a bow are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 263,162 to Stewart discloses an archery bow handle.

U.S. Pat. No. Des. 300,762 to Jennings discloses a bow handle.

U.S. Pat. No. 4,252,100 to Rickard discloses an archery bow with movable handle.

U.S. Pat. No. 4,457,287 to Babington discloses an archery bow assembly having a universally mounted handle.

U.S. Pat. No. 4,836,964 to Tsai discloses a method of producing a bow holding handle.

U.S. Pat. No. 4,996,968 to Hollingsworth discloses a handle apparatus for compound bow.

While these devices fulfill their respective, particular objective and requirements, the aforementioned patents do not describe a bow handle that is simple in design and allows a bow to be easily carried from one location to another.

In this respect, the bow handle according to the present invention substantially departs from the conventional concepts and designs of the prior art, and in doing so provides an apparatus primarily developed for the purpose of holding and carrying a bow.

Therefore, it can be appreciated that there exists a continuing need for new and improved bow handle which can be used for holding and carrying a bow. In this regard, the present invention substantially fulfills this need.

SUMMARY OF THE INVENTION

In the view of the foregoing disadvantages inherent in the known types of bow handles now present in the prior art, the present invention provides an improved bow handle. As such, the general purpose of the present invention, which will be described subsequently in greater detail, is to provide a new and improved bow handle and method which has all the advantages of the prior art and none of the disadvantages.

To attain this, the present invention essentially comprises, in combination, a rigid arm having a flattened base end, a bored tip end, a curved first intermediate location between the base end and tip end, and a curved second intermediate location between the first intermediate location and tip end with a linear intermediate segment extended between the first intermediate location and the second intermediate location, a linear base segment perpendicularly extended outwards from the first intermediate location to the base end, and a linear tip segment perpendicularly extended outwards from the second intermediate location to the tip end in a direction opposite the extension of the base segment. An essentially rectangular and planar mounting bracket is included and has a top surface, a bottom surface, and a plurality of mounting holes disposed thereon with the top surface coupled to the base end of the arm, the bottom surface adapted to be positioned in contact with a sight base attachment on a bow handle, and the mounting holes adapted to be positioned in alignment with the screw holes on the sight base attachment of the bow handle. A plurality of mounting screws is included with each mounting screw extended through a mounting hole on the mounting bracket and threadably coupled within a screw hole of a sight base attachment on a bow, thereby coupling the mounting bracket and arm to the bow handle. A collar is included and has a ringed portion with a neck extended therefrom and slidably and rotatably disposed within the tip end of the arm. An elongated and rigid stabilizer rod is included and has a tipped end, a free end, and an intermediate portion therebetween with the tipped end adapted to be positioned in contact with the handle of a bow at a location offset from the mounting bracket and the intermediate portion linearly extended from the tip end and through the collar to terminate at the free end. A string guide is included and coupled around the intermediate portion of the stabilizer rod between the free end thereof and the collar with the string guide having a plurality of grooves extended therealong adapted to receive and fixedly hold a plurality of bow strings extended across the bow handle. A thumbscrew is included and disposed through the ringed portion of the collar for fixing the position of the stabilizer rod therein, whereby allowing the string guide to be placed in a stationary position for holding bow strings therein. A set screw is included and disposed through the tip end of the arm for fixing the orientation of the collar such that the stabilizer bar and arm define a carrying configuration. Lastly, a handle is included and coupled around the tip segment of the arm and adapted for allowing a user a firm grip of the carrying configuration.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bow handle which has all the advantages of the prior art bow handles and none of the disadvantages.

It is another object of the present invention to provide a new and improved bow handle which may be easily and efficiently manufactured and marketed.

It is a further object of the present invention to provide a new and improved bow handle which is of durable and reliable construction.

An even further object of the present invention is to provide a new and improved bow handle which is susceptible of a low cost of manufacture with regard to both materials and labor, and which accordingly is then susceptible of low prices of sale to the consuming public, thereby making such a bow handle economically available to the buying public.

Still yet another object of the present invention is to provide a new and improved bow handle which provides in the apparatuses and methods of the prior art some of the advantages thereof, while simultaneously overcoming some of the disadvantages normally associated therewith.

Even still another object of the present invention is to provide a new and improved bow handle for holding and carrying a bow.

Lastly, it is an object of the present invention to provide a new and improved bow handle comprising a rigid arm having a base end, a tip end, and an intermediate location therebetween with a base segment extended outwards from the intermediate location to the base end and a tip segment extended outwards and away from the base segment from the intermediate location to the tip end; first coupling means for coupling the base end of the arm to the bow handle; a collar coupled to the tip end of the arm; a stabilizer rod having a tip end adapted to be positioned in contact with the handle of a bow and a free end slidably disposed through the collar; string guide means coupled to the stabilizer rod and adapted for receiving and holding a plurality of bow strings extended across a bow handle; and second coupling means for fixing the position of the stabilizer rod relative to the collar.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side-elevational view of the preferred embodiment of the bow handle constructed in accordance with the principles of the present invention.

FIG. 2 is an enlarged side-elevational view of the present invention of FIG. 1.

FIG. 5 is a cut-away view of the stabilizer bar depicted in FIG. 1.

FIG. 6 is a cross-sectional view of the coupling between the mounting bracket and base end of the arm as well as the coupling between the mounting bracket and sight base on a bow handle taken along the line 6—6 of FIG. 2.

The same reference numerals refer to the same parts through the various Figures.

DESCRIPTION OF THE PREFERRED EMBODIMENT

Figure 3:
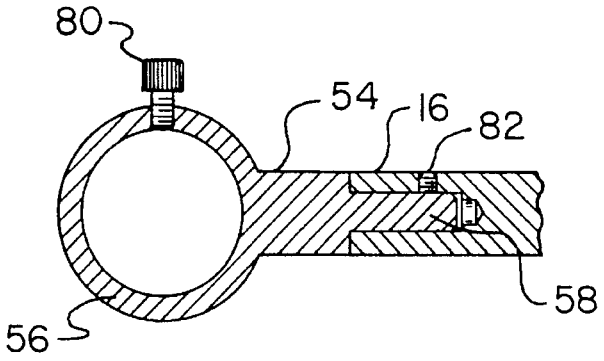
FIG. 3 is a cross-sectional view of the collar taken along the line 3—3 of FIG. 2.
Figure 4:
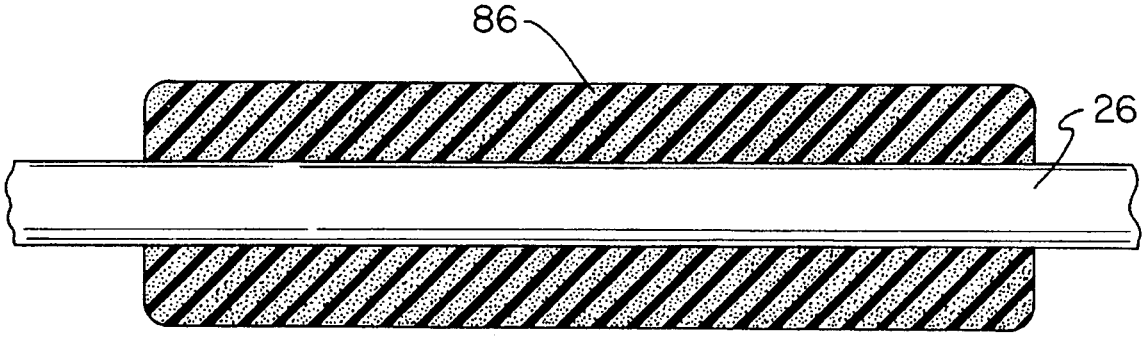
FIG. 4 is a cross-sectional view of the handle taken along the line 4—4 of FIG. 2.

With reference now to the drawings, and in particular, to FIG. 1 thereof, the preferred embodiment of the new and improved bow handle embodying the principles and concepts of the present invention and generally designated by the reference number 10 will be described.

Specifically, the present invention includes 9 major components. The major components are the arm, mounting bracket, mounting screws, collar, stabilizer rod, string guide, thumbscrew, set screw, and handle. These components are interrelated to provide the intended function.

More specifically, it will be noted in the various Figures that the first major component is the arm 12. The arm is rigid in structure. It has a flattened base end 14 and a bored tip end 16. The arm also has a curved first intermediate location 18 between the base end and tip end and a curved second intermediate location 20 between the first intermediate location and the tip end. A linear intermediate segment 22 is extended between the first intermediate location and the second intermediate location. A linear base segment 24 is perpendicularly extended outwards from the first intermediate location to the base end. Furthermore, a linear tip segment 26 is perpendicularly extended outwards from the second intermediate location to the tip end in a direction opposite the extension of the base segment. This configuration forms a modified S-shaped structure.

The second major component is the mounting bracket 30. The mounting bracket is essentially rectangular and planar in structure. It has a top surface 32, a bottom surface 34, and a plurality of mounting holes 36 disposed thereon. The top surface of the mounting bracket is coupled to the base end 14 of the arm with a plurality of detent-like screws. The bottom surface of the mounting bracket is adapted to be positioned in contact with a sight base attachment 38 on a bow handle 40. The sight base attachment on the bow handle is used as a foundation from which to launch arrows from the bow. The mounting holes are adapted to be positioned in alignment with the screw holes 42 on the sight base attachment of the bow handle. Normally, the sight base attachment is adapted to be attached to a bow handle through a set of screw holes. These same screw holes are used as a support for holding the mounting bracket to the bow handle.

The third major component is the mounting screws 50. The present invention includes a plurality of mounting screws. Each mounting screw is extended through a mounting hole 36 on the mounting bracket 30 and threadably coupled within a screw hole 42 of a sight base attachment 38 on a bow 40. The screws thereby couple the mounting bracket and corresponding arm to the bow handle.

The fourth major component is the collar 54. The collar is rigid in structure. It has a ringed portion 56 with a neck 58 extended outwards therefrom. The neck is slidably and rotatably disposed within the tip end 16 of the arm.

The fifth major component is the stabilizer rod 60. The stabilizer rod is elongated and rigid in structure. It has a tipped end 62, a free end 64, and an intermediate portion 66 therebetween. The tipped end is adapted to be positioned in contact with the bow handle at a location offset from the mounting bracket 30. The intermediate portion of the stabilizer rod is linearly extended from the tip end and through the ringed portion 56 of the collar to then terminate at the free end. The free end is extended a distance outwards from the tips of the bow handle and away from the bow string thereof.

The sixth major component is the string guide 70. The string guide is coupled around the intermediate portion of the stabilizer rod 60 between the free end 64 thereof and the collar 54. The string guide has a plurality of grooves 72 extended therealong. These grooves are adapted to receive and fixably hold a plurality of bow strings 74 extended across the tip ends of the bow handle 40. The string guide insures that the bow strings will not be inadvertently pulled in one direction or another. This allows the bow to be transported in areas of heavy vegetation without the string easily becoming hooked.

The seventh major component is the thumbscrew 80. The thumbscrew has a head at one end and a threaded portion at the other end. The head is knurled for allowing a user a firm grip thereof. The thumbscrew is disposed through the ring portion 56 of the collar. It is used for fixing the position of the stabilizer rod 60 and its extension towards the portion of the bow handle between the tip ends thereof. The thumbscrew allows the string guide 70 to be adjusted and then placed in a stationary position for holding bow strings 74 therein.

The eighth major component is the set screw 82. The set screw has a threaded portion with a notch on one end adapted to receive a wrench. The threaded portion of the set screw is disposed through the tip end 16 of the arm and clamped against the neck 58 of the collar. The set screw thereby fixes the orientation of the collar 54 such that the stabilizer bar 60 and arm 12 define a general H-shaped carrying configuration 84.

The ninth major component is the handle 86. The handle is formed of foam rubber or other similar gripping material. The handle is coupled around the tip segment 26 of the arm. It is formed with curves to conform to a user's hand and fingers for allowing a user a firm grip of the H-shaped carrying configuration 84.

The present invention is adapted to fit on any bow without modification or drilling thereof. The present invention is adapted to provide a solid carrying configuration. In the preferred embodiment, the arm, collar, stabilizer rod, and screws are made of metal, preferably aluminum. The handle, tip end of the stabilizer bar, and string guide are made of foam rubber or other polymer-based compound. The stabilizer bar is adapted to prevent movement of the bow strings relative to the bow handle. Besides providing an integral part of the carrying configuration, the stabilizer rod also protects the bow strings extended between the tip ends of the bow handle and arrows positioned along the extent of the bow handle from damage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A combination bow handle and bow stabilizer for holding and carrying a bow comprising, in combination:

a rigid arm having a flattened base end, a bored tip end, a curved first intermediate location between the base end and tip end, and a curved second intermediate location between the first intermediate location and tip end with a linear intermediate segment extended between the first intermediate location and the second intermediate location, a linear base segment perpendicularly extended outwards from the first intermediate location to the base end, and a linear tip segment perpendicularly extended outwards from the second intermediate location to the tip end in a direction opposite the extension of the base segment;

an essentially rectangular and planar mounting bracket having a top surface, a bottom surface, and a plurality of mounting holes disposed thereon, the top surface coupled to the base end of the arm, the bottom surface adapted to be positioned in contact with a sight base attachment on a bow, and the mounting holes adapted to be positioned in alignment with the screw holes on the sight base attachment of the bow;

a plurality of mounting screws, each mounting screw extended through a mounting hole on the mounting bracket and threadably coupled within a screw hole of a sight base attachment on a bow, thereby coupling the mounting bracket and arm to the bow;

a collar having a ringed portion with a neck extended therefrom and slidably and rotatably disposed within the tip end of the arm;

an elongated and rigid stabilizer rod having a tipped end, a free end, and an intermediate portion therebetween, with the tipped end adapted to be positioned in contact with the handle of a bow at a location offset from the mounting bracket and the intermediate portion linearly extended from the tip end and through the collar to terminate at the free end;

a string guide coupled around the intermediate portion of the stabilizer rod between the free end thereof and the collar, the string guide having a plurality of grooves extended therealong adapted to receive a plurality of bow strings extended across the bow;

a thumbscrew disposed through the ringed portion of the collar for fixing the position of the stabilizer rod therein, whereby allowing the string guide to be placed in a stationary position for holding bow strings therein;

a set screw disposed through the tip end of the arm for fixing the orientation of the collar such that the stabilizer rod and arm define a carrying configuration; and a handle coupled around the tip segment of the arm and adapted for allowing a user a firm grip of the carrying configuration.

2. A combination bow handle and bow stabilizer for holding and carrying a bow comprising, in combination:

a rigid arm having a base end, a tip end, and an intermediate location therebetween with a base segment extended outwards from the intermediate location to the base end and a tip segment extended outwards and away from the base segment from the intermediate location to the tip end;

first coupling means for coupling the base end of the arm to the bow;

a collar coupled to the tip end of the arm;

a stabilizer rod having a tip end adapted to be positioned in contact with the handle of a bow and a free end slidably disposed through the collar;

string guide means coupled to the stabilizer rod and adapted for receiving and holding a plurality of bow strings extended across the bow; and second coupling means for fixing the position of the stabilizer rod relative to the collar.

3. The bow handle as set forth in claim 2 further including a handle coupled around the tip segment of the arm and adapted for allowing a user a firm grip thereof.

* * * * *